US007191470B2

(12) United States Patent
Benini

(10) Patent No.: US 7,191,470 B2
(45) Date of Patent: Mar. 20, 2007

(54) TORSO GARMENT

(75) Inventor: Bryon Benini, Cardiff By The Sea, CA (US)

(73) Assignee: Dye Precision, Inc., San Diego, CA (US)

( * ) Notice: Subject to any disclaimer, the term of this patent is extended or adjusted under 35 U.S.C. 154(b) by 901 days.

(21) Appl. No.: 10/322,170

(22) Filed: Dec. 17, 2002

(65) Prior Publication Data

US 2005/0114978 A1 Jun. 2, 2005

(51) Int. Cl.
*A41D 13/00* (2006.01)

(52) U.S. Cl. ..... 2/69

(58) Field of Classification Search ..... 2/455, 2/44, 45, 94, 95, 267, 268, 69, 102
See application file for complete search history.

(56) References Cited

U.S. PATENT DOCUMENTS 2,302,368 A * 11/1942 Evans ..... 2/94
2,948,899 A * 8/1960 Allen ..... 2/94
4,353,133 A * 10/1982 Williams ..... 2/459
4,669,125 A * 6/1987 Allen ..... 2/459
4,882,786 A * 11/1989 Gross ..... 2/94

* cited by examiner

*Primary Examiner*—Tejash Patel
(74) *Attorney, Agent, or Firm*—Richard D. Clarke

(57) ABSTRACT

The present invention provides a garment for playing paintball which is a torso-covering garment having at least two mirror-image gripping regions each containing one or more gripping areas that bear a plurality of raised tacky protrusions on one or more portions of the garment which covers at least a portion of the torso, that is, one or more of the shoulder, chest, and abdominal areas of the torso. The garment enables the paintball player to grippably contact a gripping area of the garment with the curved rear portion of the air system tank of the paintball marker, which enhances stability and improves shooting accuracy. Further provided is a method of playing paintball which comprises wearing the garment of the invention while playing paintball.

12 Claims, 4 Drawing Sheets

TORSO GARMENT

BACKGROUND OF THE INVENTION

1. Field of the Invention

This invention relates to a garment worn by a paintball player. The garment has a sticky surface for positioning and griping the butt stock of a gun against the garment wearer's torso.

2. Description of Related Art

In the sport of paintball, a player wears a garment which covers the torso. When aiming and shooting, the user stabilizes the gun to improve accuracy by pressing the butt end of the paintball gun to the torso garment.

A common problem in the sport of paintball is that the butt end of a paintball gun, which is an air tank, easily slips off of the user's shoulder or chest or other portion of the torso when the user contacts the torso-covering garment with the butt end of the tank to support the gun for shooting accuracy.

The butt end of the tank typically has a round, smooth surface with a low coefficient of friction in contact with commercially available garments, such as jackets, jerseys, vests or other garment configured to cover and protect the paintball player's torso, and made of material which allows the butt end of the tank in contact with the material to easily slip or slide. This makes it difficult for the user to achieve shooting accuracy.

The present invention overcomes this problem by providing a torso-covering or torso-encircling garment which has gripping, non-skid surface on at least a portion of the garment which grippingly contacts the butt end of the tank when the player attempts to support or stabilize the gun against the torso for shooting accuracy.

SUMMARY OF THE INVENTION

The present invention provides a garment for playing paintball which is a torso-covering garment having at least two mirror-image gripping regions each containing one or more gripping areas that bear a plurality of raised tacky protrusions on one or more portions of the garment which covers at least a portion of the torso, that is, one or more of the shoulder, chest, and abdominal areas of the torso. The garment enables the paintball player to grippably contact a gripping area of the garment with the curved rear portion of the air system tank of the paintball marker, which enhances stability and improves shooting accuracy. Further provided is a method of playing paintball which comprises wearing the garment of the invention while playing paintball.

The garment, which has a body side, comprises one or more flexible fabrics. The fabric has an outer side comprising one or more gripping areas. Each gripping area comprises a pliant, non-cushioning substrate. The substrate has a sticky surface for gripping engagement or contact between the butt stock of the user's gun and the gripping area. The garment covers at least a portion of the user's torso. Among common embodiments of the garment are shirts, jerseys, jackets, and vests.

DETAILED DESCRIPTION

Definitions

The term "garment" means an article of clothing, especially outer clothing. Garments are articles which include shirts, jerseys, jackets, and vests. Torso garments include torso-encircling articles or articles configured to be worn about all or part of a torso, attached to a torso-covering garment, or worn about another torso-covering article. In the context of this disclosure, stabilizing the butt stock against the torso or placing the butt stock against the torso should be understood to mean that the butt stock is positioned against a garment being worn over the torso.

The term "flexible" as in "flexible fabric" refers to fabric which is pliant, and which is used in the manufacture of articles of clothing.

"Sticky surface" is a term which is used herein to mean a surface which provides a gripping or adhesive force mediated by friction and/or suction against the butt stock of a gun, for example, the tank of a paintball gun. The sticky surface, disposed on an outer surface of the substrate in a gripping area of the garment, achieves gripping or gripping engagement in contact with the butt stock of a gun which has a surface that would ordinarily slip in contact with a garment which does not have a sticky or gripping surface.

A "gripping area" 15 is sticky surface together with the substrate 50. A gripping area can have a variety of planar shapes consisting of polygonal and curvilinear, and includes without limitation, substantially circular, substantially rectangular, substantially trapezoidal and substantially triangular, including square, rectangle, circle, oval, or irregular shapes, and combinations thereof as desired, for more or less effect, as desired. Gripping areas of similar shape can be reconfigured on the torso. The garment comprises one or more gripping areas. A gripping area is not padded.

Figure 1:
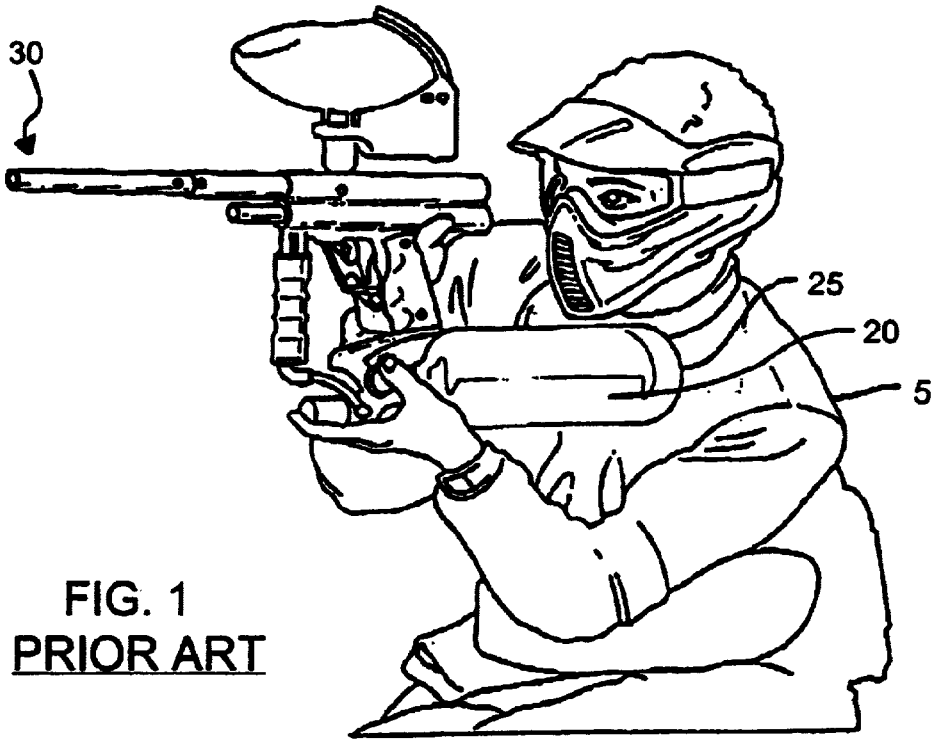
FIG. 1 PRIOR ART
FIG. 1 is an action drawing of a paintball player wearing a prior art garment, and positioning the butt stock of the paintball gun against the prior art garment covering the torso.
Figure 2:
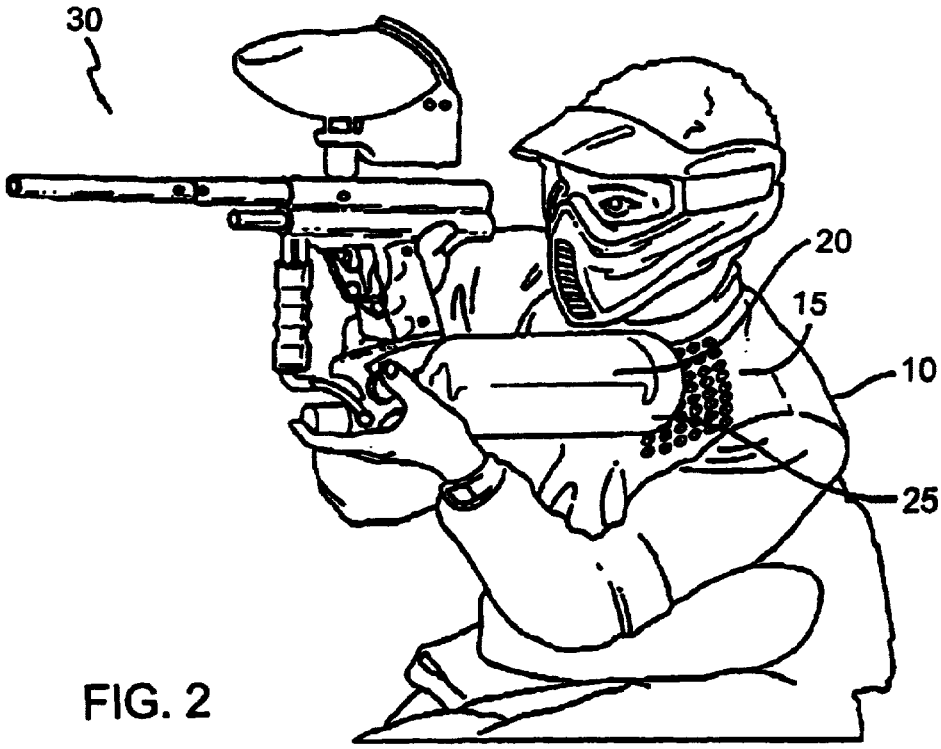
FIG. 2 is an action drawing of a paintball player wearing a torso garment of the invention. The player is aiming and/or shooting by positioning the butt stock of a paintball gun against a gripping area located in a shoulder area of the torso.

The "butt stock" 25 or "buff" of a gun refers to the portion of the gun which is held against the torso or shoulder to improve the user's aim of the gun. In a broader sense, a butt stock refers to any structure of a gun which the user places against his or her torso to stabilize the gun's position to improve aim of the gun in the act of shooting. The butt stock of a paintball gun is typically the rear end 25 of the air system tank 20, as shown in FIGS. 1 and 2. The rear end 25 of the air system tank 20 is generally curved in shape and contains a smooth surface. Because of the shape and surface texture of rear end 25 of air system tank 20, unwanted slippage can occur during aiming or firing of the paintball gun.

As used herein, the term "body side" denotes a position relative to the user's body and does not necessarily imply that the body side is contiguous with the outer side. For example, a laminate structure may contain multiple layers on the body side and the outer side.

The term "substrate" means a flexible material of suitable strength and durability so that it can be used in the construction of the articles of the invention. In the context of the present invention, a substrate can be the fabric of the garment as well as laminates, layers, coatings, and/or additional fabric which may be disposed between the fabric and the sticky surface.

The term "non-cushioning" means not suitable for absorbing a blow. The degree of compressibility of the gripping area of the invention is not sufficient for absorbing a blow, i.e. a gripping area is not padded. Non-cushioning materials include those which are relatively non-compressible in which the degree of compressibility is insufficient to absorb a shock or blow.

The term "coating" refers to a matrix or layer of material having sticky texture and positioned on the outer surface of the substrate. "Coating" also refers to methods of applying a coating. Coating may mean disposition of sticky material within the substrate or impregnating the substrate. Coating may also refer to disposition of sticky material as a surface layer upon the substrate. Coating in the hands of one skilled in the art can be used to form continuous (i.e. uninterrupted) or protuberant gripping areas.

Figure 3:
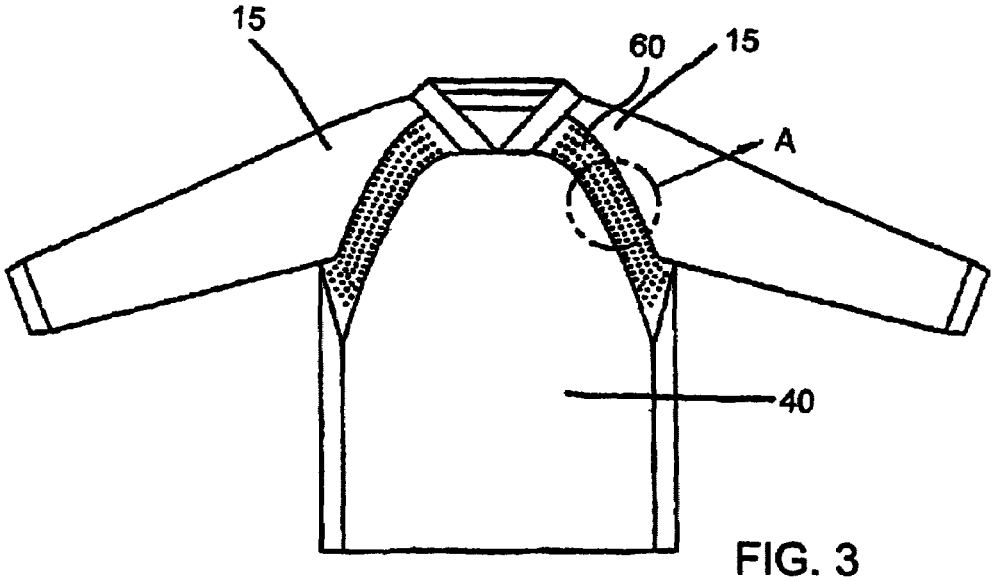
FIG. 3 is a plan view of a garment of the invention showing a gripping area of protuberances located in each shoulder area.
Figure 4:
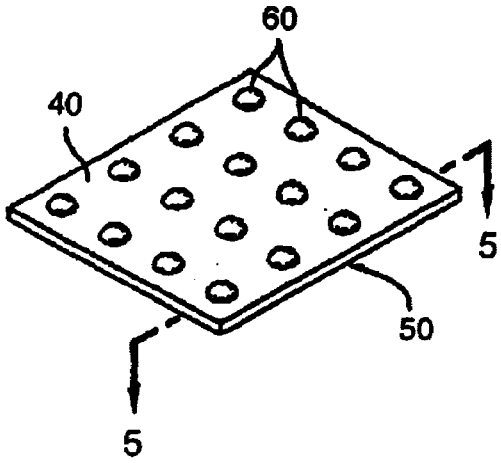
FIG. 4 is a plan view of portion A of the gripping area of FIG. 3.
Figure 5:
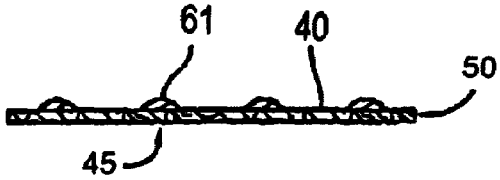
FIG. 5 is a cross section taken through line 5—5 of FIG. 4.
Figure 6:
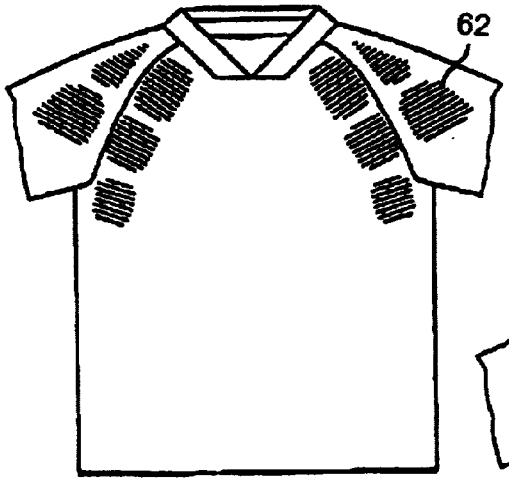
FIGS. 6–8 show gripping areas formed from protuberances configured as lines.
Figure 7:
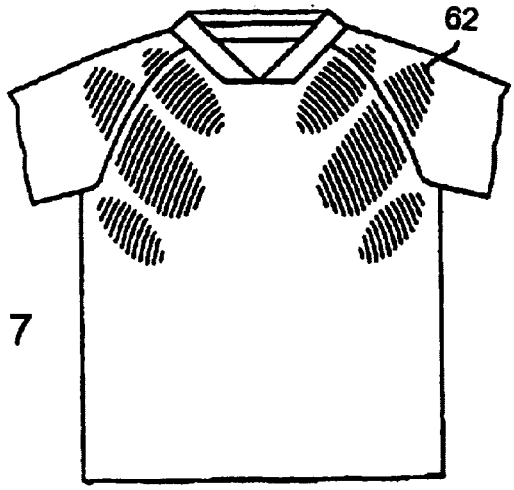

Turning to the illustrations, FIG. 1 illustrates a paintball player positioning the rear end 25 of air system tank 20 of a paintball gun 30 against a prior art garment 5, which has a slippery, non-grip surface which allows rear end 25 of air system tank 20 to slip or slide upon the garment. As shown in FIG. 2, there is depicted a paintball player positioning the rear end 25 of air system tank 20 of a paintball gun 30 against a garment 10 according to the present invention, which has a gripping area 15 that prevents rear end 25 of air system tank 20 from slipping or sliding upon garment 10. There is shown in FIG. 3 a plan view of a garment of the invention which illustrates two gripping areas 15, each contoured to the anatomy of the shoulder area against which a paintball player stabilizes the rear end 25 of air system tank 20 for improving shooting accuracy. Each gripping area 15 contains a plurality of sticky protuberances 60 formed from a non-skid or sticky material disposed on a substrate 50 (as shown in FIG. 4). FIG. 4 depicts a cross section of a gripping area 15 in the area of FIG. 3 labeled A, including sticky protuberances 60 formed on top surface 40 of substrate 50. There is seen in FIG. 5 a cross-section of substrate 50 at line 5—5 in FIG. 4, illustrating a hillock 61 on top surface 40 of substrate 50. Bottom surface 45 of substrate 50 is also seen in the figure.

Gripping Area. A gripping area 15 has sufficient surface area to create "gripping engagement, which means sufficient gripping friction between the butt end of the tank and the gripping area to retard or prevent slipping of the butt end of the tank over the outer side of the garment comprising a gripping area to enhance aiming the gun. A sufficient area for gripping engagement with the butt end of the tank can be as small as about 1 square inch. Preferred sizes for gripping areas range upwards from about 6 square inches.

A gripping area 15 can be formed from a plurality of sticky surfaces configured in a gripping area. As shown in FIGS. 3–5, a gripping area comprises a plurality of sticky protuberances 60 formed from a non-skid or sticky material disposed on substrate 50 of gripping area 15. Examples of sticky material are set forth below, and include silicone. To form a gripping area 15 with sufficient frictional or sticky quality for a user to achieve gripping engagement of the butt stock 25 of a gun in contact with gripping area 15, a sufficient number of sticky protuberances 60 are spaced or patterned sufficiently close together on substrate 50 to collectively provide gripping engagement between the plurality of sticky protuberances 60 and the butt stock 25 of the gun. A protuberance is any volumetric shape that juts, bulges or otherwise projects outward from the substrate in a gripping area.

FIGS. 3, 4, 5 show protuberances 60 shaped as hillocks 61. Protuberances 60 can be arranged in any pattern or combination of shapes and patterns so long as collectively they provide sufficient friction to grippingly engage butt stock 25 of air system tank 20. Other planar shapes and patterns are equally attainable without deviating from an object of the invention to provide sufficient friction to grippingly engage butt stock 25 of air system tank 20. A protuberance 60 could, in cross-section, be substantially circular, substantially rectangular, substantially trapezoidal or substantially triangular.

Although the desired density of protuberances is variable, it may be practically undesirable for some embodiments to have a single protuberance which lacks sufficient grippability to grip the butt end of the gun. On the other extreme, the stickiness applied to the butt stock is delivered vis a vis the end points of the protuberances and divided among these points. Therefore, the more protuberances in a gripping area, the gripping effect of the end points is enhanced and less pressure or force is required to grippingly engage the butt stock to the garment.

Figure 9:
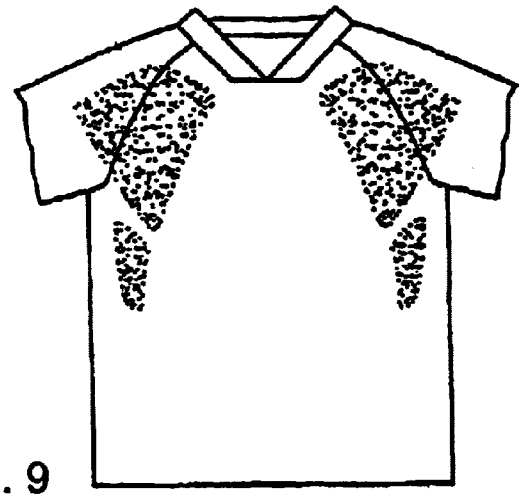
FIG. 9 shows a gripping area formed from a random arrangement of hillocks within each gripping area.
Figure 10:
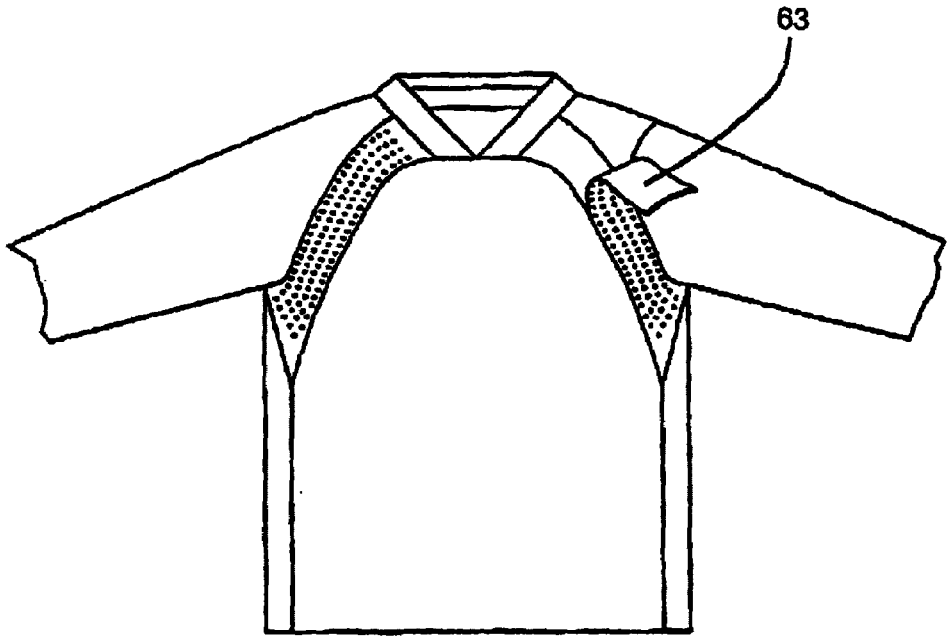
FIG. 10 shows gripping areas which are patches attached to a shoulder area of the garment.

The garment of the invention is not restricted in scope to the disclosed patterns of gripping areas 15, ranging from lines 62 to circles and dots as shown in FIGS. 9 and 10, or patterns of protuberances of gripping areas 15. Also as shown in FIGS. 9 and 10, there can be two or more gripping areas 15 grouped into a gripping region and there can exist two mirror-image gripping regions substantially within the torso region of the garment.

In preferred embodiments, protuberances should have a substantially uniform height dimension to uniformly apply gripping friction to the butt stock. Protuberances of varying height may employed in certain applications and are within the scope of this invention. A combination of shorter and longer protuberances may be desirable to provide certain gripping characteristics.

Figure 8:
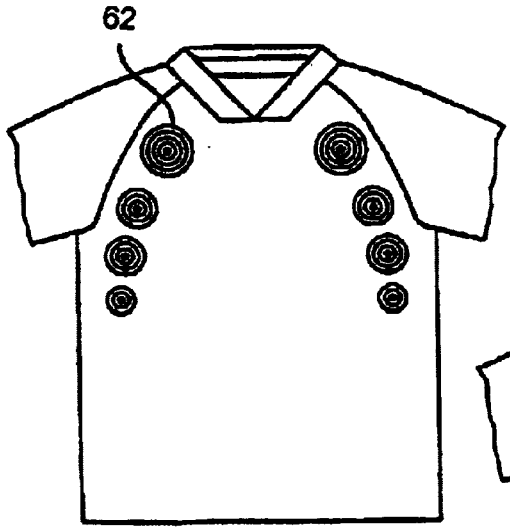

Protuberances may be arranged on a substrate in any manner. They can be arranged in a random manner or uniformly. As shown in FIG. 8, protuberances are arranged in concentric rings.

Operation of the Garment. In use, when a gripping area 15 of the garment is engaged with the butt stock 25, the sticky surface (e.g. area A of FIG. 3; area B of FIG. 4) grippingly engages the butt stock. The sticky surface of the gripping area of the garment allows the user to have more control of aim during the entire shooting process. In use with a paintball gun, the sticky surface grippingly engages the continuously curving tank surface. This is advantageous over existing garments which have outer surfaces which are not sticky and which allow a butt stock to slip, slide, or otherwise not grippingly engage the outer surface of the garment, making aim more difficult to control. During the shooting process, when the user brings the butt stock of a rifle or the tank of a paintball gun against the torso to stabilize the gun, the gripping area in that section of the torso keeps the user in closer control of the aim of the gun, and assists in more accurate handling and positioning of the gun during the shooting movements. The degree of stickiness of the sticky surface provides for a relatively smooth release when the user disengages the butt stock of, for example, the tank, from the gripping area. As the user releases the pressure of the tank against a gripping area, the force of the tank leaving the surface of the gripping area overcomes the gripping attachment and aim-enhancing force of the sticky surface.

Torso locations for a gripping area include one or both shoulder areas. Other areas include abdominal area and chest. The grip-enhancing gripping areas are positioned at all or some of the areas on the garment that contact the butt stock when the user positions the gun against the torso to improve aim. Although not preferred, the outer side of the garment and the gripping area may be coextensive.

General Construction of the Garment

The gripping area of the garment comprises a pliant or flexible substrate 50, which is non-cushioning and which has a sticky surface 35 (or collectively protuberances 60) for gripping engagement with the butt stock.

Structure of Substrate. A flexible fabric substrate is formed of natural and/or synthetic fibers, which may be woven or non-woven and spun of filament yarn of the desired length. Cotton, polyester, nylon and rayon are typical materials which may be used as fibers or yarns in this invention. For example, a substrate is a woven fabric typically used for making an athletic jersey. Flexible fabrics suitable for forming a gripping area include, but are not restricted to textiles and fabrics manufactured or supplied by DuPont, Schoeller, Top Value Fabrics, Dow, Formosa, Brookwood, John King, and the like.

A flexible fabric may consist of non-woven materials including, but not restricted to, neoprene, rubber, leather, cordura (tm) Naugahyde(tm), PVC, polyethylene, polypropylene, polyurethane, various leathers, and vinyl. Representative fibrous materials may be comprised of wool, polyesters, polyamides, such as Kevlar or Nomex which are products of DuPont, polyolefins, such as polypropylene and polyethylene and copolymers of acrylic acid, such as polyacrylonitrile. If a knitted web substrate is used, it may be cotton, polyester, or a cotton-polyester blend. If it is woven, it may be nylon or cotton. The material forming the sticky surface of the laminate, in accordance herewith, as discussed above, includes polyurethane, polyvinyl chloride, acrylonitrile, natural or synthetic rubber.

Accordingly, the invention includes a gripping surface substrate which may be a fabric web comprised of a non-woven fibrous web, a knitted fabric web such as knitted jersey, or a woven fabric, for example. The substrate may be comprised of natural or synthetic fibers or blends thereof including, for example, polyester, or a polyester-cotton blend. Preferably the gripping surface is flexible and has a degree of texture or stickiness as desired for providing a gripping surface which is non-cushioning.

Application of Sticky Material to Substrate

A sticky surface is formed on a substrate by disposing sticky matrix material on the outer side of the substrate or fabric in an amount sufficient to impart the desired grippability or stickiness for gripping engagement of the butt stock to the outer side of the garment.

The fabric substrate is spread coated, calendared, dipped or otherwise contacted with a sticky matrix material. Suitable matrix materials include thermoplastic resins, thermosetting resins, polyurethanes, or natural or synthetic elastomers. PVC and other polyolefins are suitable thermoplastic resins, while preferred polyurethanes are disclosed in U.S. Pat. Nos. 5,001,208 and 5,013,811, which are each expressly incorporated herein by reference thereto. U.S. Pat. No. 6,099,936, incorporated herein by reference, discloses a method for forming a sticky surface on a fabric by pressure-fit in which a gum may be impregnated into the textile of the fabric without the use of any adhesive agent, or may be adhered by an adhesive agent. Furthermore, the fabric may be knitted, natural gum, or synthetic rubber. Various materials, such as perfluoroelastomer rubber, nitrile rubber, silicone rubber, neoprene, vinyl, natural rubber and others, are typically used. Other materials having similar sticky qualities are equally usable to achieve the objects of the invention.

In all cases, enough sticky material is applied to the substrate to over a sufficiently large area of the garment to form one or more gripping areas with surface having the qualities of gripping or sticky engagement with the butt stock, or to impart increased gripping properties to the substrate. As will be appreciated by practitioners-in-the-art, various polymeric coatings and methods for apply the same may be used, selected from a wide variety of polymers to form a sticky surface on the substrate. These methods include, but are not limited to, fusing, heat transfer, weaving, adhesive embossing, laminating, raised inks. The sticky surface can be made of a plurality of layers of the same or different materials.

One skilled in the art is aware of a number of techniques for applying sticky matrix materials in liquid form (i.e., by a solvent solution or a latex dispersion) to a fabric substrate. These methods include silk screening, sonic welding, heat pressure or iron-on.

Other embodiments of the garment involve gripping areas comprising double-back or double-sided adhesive sheets or iron-on sticky or tacky surfaces on the outer side of the garment.

Laminates or Composites

The garment of the invention includes gripping areas which comprise a laminate in which the outer side is a sticky surface for gripping engagement between the butt stock and the gripping area surface. Typically, such gripping areas are manufactured by a variety of methods for producing a laminate useful in the manufacture of wearing apparel. (U.S. Pat. No. 4,589,940, incorporated by reference) and to laminates wherein a flexible gripping surface is required. It is appreciated that those of skill in the art possess techniques for controlling the degree of stickiness of such laminate gripping surfaces.

An embodiment of the gripping area of the invention includes substrate which is flexible, fabric and which is embossed or imprinted. Methods for making embossed fabric substrates are well known in the art, and include that disclosed in U.S. Pat. No. 6,050,965, hereby incorporated by reference.

The sticky surface can be directly attached to the outer side of a garment or to a piece of flexible fabric by adhesive, sewing, molding, spraying, silk screening, coating, sonic welding, or combinations thereof as desired. Techniques for directly attaching a sticky surface to a flexible fabric are well-known to those of ordinary skill in protective garment manufacturing.

By way of illustration but not limitation, methods of fabricating the garment of the invention include (a) a substrate in the form of the garment absent the gripping areas onto which a sticky surface is applied or secured as a coating or laminate using the techniques described herein thereby forming the garment of the invention; (b) a substrate for incorporation into or onto the garment, onto which sticky surface is applied or secured by sewing or as a coating or laminate using the techniques described herein to form a gripping area, the gripping area either whole or subdivided into pieces, and then secured into or onto the remaining substrate of the garment by sewing, glue, cement, screw, heat bond, nut and bolt arrangement, rivets, velcro strips or other hook and loop type materials, butons, snap fasteners, and the like, thereby forming the garment of the invention; (c) combinations of (a) and (b).

The substrate which is incorporated into the garment may be formed into fabric pieces prior to the application of a sticky surface, or they may be formed from a previously prepared laminate of the sticky surface and a substrate. Many different customized or mass production techniques are used in the formulation of articles (i.e. the garment of the invention) in accordance with this invention. Obviously a variety of mass production techniques may be applied making the products of the invention here highly advantageous commercially.

FIG. 10 shows a garment that has gripping areas shaped formed as patches 63 positioned at selected locations on the frontal torso of the garment. The patches 63 can be attached with a removable attachment material, such as hook and loop material (e.g. Velcro-tm)) appropriately fixed to the garment and the patch. The attachment material should be secure enough to keep the sticky material or grip-enhancing material from being removed from the garment when the butt stock is released from the garment. The patches can have a variety of shapes, including squares, rectangles, circles, ovals, or irregular shapes, as desired, for more or less effect, as desired. Patches of differing shape can be used for different applications, or patches of similar shape can be reconfigured on the torso.

While the sticky material of the gripping area allows the user to have greater control over the gripped object, i.e. the butt stock, it should be understood that the gripping area does not help cushion the user's torso from the force of the blow of the butt end of the tank against the torso.

It is envisioned that the gripping area will enhance gripping of a variety of shapes of a butt stock, such as the air system tank of a paintball gun, which is typically a cylindrically-shaped object, as well as to other irregularly shaped objects. As long as the shape of butt stock and the surface of the butt stock allow at least a gripping force to be developed between the gripping area and the surface of the butt stock, the grip-enhancing sticky surface will improve aim-control. The aim-control enhancing quality of the gripping area works when used to enhance the control via friction or suction on a relatively smooth surface, such as plastic, polished leather, metals, or the like.

What is claimed is:

1. A garment for stabilizing the curved rear portion of the air system tank of a paintball marker to a wearer's torso, the garment comprising flexible fabric, said fabric comprising:

a) an inner surface, said inner surface designed to come into contact with the body of the wearer; and b) an outer surface exterior to said inner surface, said outer surface containing at least two mirror-image gripping regions substantially located within the torso region of the garment, each of said at least two mirror-image gripping regions comprising a pliant, non-cushioning substrate, said substrate having a plurality of raised tacky protrusions for the purpose of gripping engagement between the curved rear portion of the air system tank and said substrate wherein the garment is configured to cover at least a portion of the wearer's torso.

2. The garment for stabilizing the curved rear portion of the air system tank of a paintball marker to a wearer's torso of claim 1, wherein the garment comprises a plurality of fabrics.

3. The garment for stabilizing the curved rear portion of the air system tank of a paintball marker to a wearer's torso of claim 1, wherein the shape of said substrate is selected from the group of shapes consisting of polygonal, curvilinear, and combinations thereof.

4. The garment for stabilizing the curved rear portion of the air system tank of a paintball marker to a wearer's torso of claim 3, wherein the shape of said substrate is selected from the group of shapes consisting of substantially circular, substantially rectangular, substantially trapezoidal and substantially triangular.

5. The garment for stabilizing the curved rear portion of the air system tank of a paintball marker to a wearer's torso of claim 1, wherein each of said at least two mirror-image gripping regions are located in each shoulder area.

6. The garment for stabilizing the curved rear portion of the air system tank of a paintball marker to a wearer's torso of claim 1, wherein the garment is selected from the group of garments consisting of a shirt, a jersey, and a vest.

7. A garment for stabilizing the curved rear portion of the air system tank of a paintball marker to a wearer's torso, the garment comprising flexible fabric, said fabric comprising:

a) an inner surface, said inner surface designed to come into contact with the body of the wearer; and b) an outer surface exterior to said inner surface, said outer surface containing at least two mirror-image gripping regions substantially located within the torso region of the garment, each of said at least two mirror-image gripping regions comprising at least two pliant, non-cushioning substrates, each of said substrates having a plurality of raised tacky protrusions for the purpose of gripping engagement between the curved rear portion of the air system tank and each of said substrates wherein the garment is configured to cover at least a portion of the wearer's torso, the garment selected from the group of garments consisting of a shirt, a jersey, and a vest.

8. The garment for stabilizing the curved rear portion of the air system tank of a paintball marker to a wearer's torso of claim 7, wherein the garment comprises a plurality of fabrics.

9. The garment for stabilizing the curved rear portion of the air system tank of a paintball marker to a wearer's torso of claim 7, wherein the shape of each of said substrates is selected from the group of shapes consisting of polygonal, curvilinear, and combinations thereof.

10. The garment for stabilizing the curved rear portion of the air system tank of a paintball marker to a wearer's torso of claim 7, wherein the shape of each of said substrates is selected from the group of shapes consisting of substantially circular, substantially rectangular, substantially trapezoidal, and substantially triangular.

11. A method for playing the sport of paintball, said method comprising the steps of:

a) wearing a torso garment comprising at least two mirror-image gripping regions containing a pliant, non-cushioning substrate, said substrate having a plurality of raised tacky protrusions for the purpose of gripping engagement between the curved rear portion of the air system tank of a paintball marker and each of said substrates;

b) contacting at least one of said at least two mirror-image gripping regions with the curved rear portion of the air system tank of the paintball marker for the purpose of achieving gripping engagement between each of said substrates and the curved rear portion of the air system tank of a paintball marker; and c) shooting the paintball marker.

12. A method of making a garment for stabilizing the curved rear portion of the air system tank of a paintball marker to the torso of a wearer of the garment comprising the steps of:

a) forming a flexible fabric in the shape of an article configured to cover at least a portion of the wearer's torso; and b) forming at least two mirror-image gripping regions on the outer side of said fabric, each of said at least two mirror-image gripping regions comprising a pliant, non-cushioning substrate, said substrate having a plurality of raised tacky protrusions for the purpose of gripping engagement between the curved rear portion of the air system tank and said substrate.

* * * * *